US008113315B2

(12) United States Patent
Farley et al.

(10) Patent No.: US 8,113,315 B2
(45) Date of Patent: Feb. 14, 2012

(54) REAR DECK SERVICE LADDER AND HANDLE ASSEMBLY FOR COMBINES

(75) Inventors: Herbert M. Farley, Elizabethtown, PA (US); Andrew V. Lauwers, Stevens, PA (US); Marion D Mencer, III, Lancaster, PA (US)

(73) Assignee: CNH America LLC, New Holland, PA (US)

( * ) Notice: Subject to any disclaimer, the term of this patent is extended or adjusted under 35 U.S.C. 154(b) by 974 days.

(21) Appl. No.: 12/082,932

(22) Filed: Apr. 15, 2008

(65) Prior Publication Data

US 2009/0255758 A1 Oct. 15, 2009

(51) Int. Cl.
*E06C 5/00* (2006.01)

(52) U.S. Cl. ..... 182/86; 182/127

(58) Field of Classification Search ..... 182/127, 182/85, 86, 95, 97, 163
See application file for complete search history.

(56) References Cited

U.S. PATENT DOCUMENTS

| | | | | |
|---|---|---|---|---|
| 374,217 | A | 12/1887 | Vincent | |
| 1,146,559 | A | 7/1915 | Fuller | |
| 3,869,022 | A | 3/1975 | Wallk | |
| 3,999,334 | A | 12/1976 | Webb | |
| 4,131,293 | A * | 12/1978 | Kindle | 280/166 |
| 4,161,997 | A | 7/1979 | Norman | |
| 5,064,022 | A * | 11/1991 | Graham | 182/85 |
| 5,339,919 | A * | 8/1994 | Boyd | 182/85 |
| 6,378,654 | B1 | 4/2002 | Ziaylek, Jr. et al. | |
| 6,739,349 | B2 | 5/2004 | Kastenschmidt et al. | |
| 2003/0221908 | A1 * | 12/2003 | Fix | 182/127 |
| 2007/0256894 | A1 | 11/2007 | Horn et al. | |

FOREIGN PATENT DOCUMENTS

| | | |
|---|---|---|
| EP | 0065580 | 12/1982 |
| JP | 8218756 | 8/1996 |
| JP | 9183339 | 7/1997 |

* cited by examiner

*Primary Examiner* — Alvin Chin Shue
(74) *Attorney, Agent, or Firm* — Michael G. Harms

(57) ABSTRACT

A ladder assembly for accessing an elevated platform of a work machine such as an agricultural combine includes an upper ladder portion connected to an upstanding handrail of the elevated platform for upward and downward movement, and a combination lower ladder portion and handle assembly carried on the lower end of the upper ladder portion and pivotable between a stowed position generally vertically coextensive with at least a portion of the upper ladder portion, and a deployed position extending downwardly. A latch mechanism holds the lower ladder portion in the stowed position. The handle is positioned for use to move the ladder down and up, is manipulable to release the latch, and pivots out of the way when the ladder is deployed. The lower ladder portion can also carry a trim panel which covers a portion of the ladder when stowed.

14 Claims, 9 Drawing Sheets

REAR DECK SERVICE LADDER AND HANDLE ASSEMBLY FOR COMBINES

TECHNICAL FIELD

The present invention relates to devices and methods for accessing the engine servicing platforms of combine harvesters, and it particularly relates to latches and handle assemblies for using such ladders at the rear of a combine.

BACKGROUND ART

A variety of different ladders are presently known to provide access between the ground and the engine service platform of a combine. Folding ladders incorporating spring biased over-centering linkages to hold the ladders in stowed or closed positions without the need of a separate latching mechanism, have been known since 1978 from U.S. Pat. No. 4,131,293 by Kindle. However, typical ladders for combines remain relatively short, on the order of three to five steps, and typically the ladders simply swing or pivot from deployed position into a position for storage. Additionally, several folding step arrangements are in the prior art. Also ladders that fold into or against a vehicle body are known, and there are known embodiments utilizing tracks to align a ladder into a storage hold.

However, there are certain recent model combines which have functional drawbacks inhibiting the deployment of ladders at the extreme rear end of the combine. Principally, among these drawbacks, is the difficulty of accommodating the discharge of straw and other M.O.G. (material other than grain) at the rear of the combine. That is, the ladder must be stored while also allowing ample room for the discharging straw and M.O.G. to flow freely, without being obstructed by the ladder. For purposes of homologation, the ladder, when deployed, must be long enough to extend beyond the discharge opening. Also, prior art ladders do not accommodate variations in vehicle height resulting from variation in the tire package. Furthermore, the ladders, when in the storage position at the rear, will accumulate straw and M.O.G. discharge, which subsequently spills onto the operator when he manually deploys the ladder into the service position. Also, the secondary mechanisms for positioning the access ladders in either the storage or working positions, such as push/pull cables or linkages would typically be inaccessible and unreliable at the rear of the combine.

An adjustable handle and latching mechanism, for positively positioning rear ladders, that would be reliable and accessible, would provide an unexpected advancement in combine harvester design, while satisfying a longfelt need for rearwardly accessing combine harvester engine service platforms, when there is a discharge port located at the rear of the combine.

SUMMARY OF THE INVENTION

The above-described drawbacks and others which will be apparent to those skilled in the art are overcome by a ladder assembly that features a storage latch whose release actuation 63 is integrated into its handle assembly. A handle arm of handle assembly, attached to a rotatable bracket, when lifted, rotates the bracket, via a curved slot and stop button, into contacting a latch having a release lever biased by a tension spring, allowing adequate travel for a protrusion on the bracket to slowly actuate release, while maintaining secure feel for the operator when latching and unlatching the ladder during deployment from its storage position. Trim panels, on the combine, protect the handle for the ladder deployment from varying heights, and allow modifying an individual ladder's access or grasping point.

DETAILED DESCRIPTION OF THE INVENTION

Figure 1:
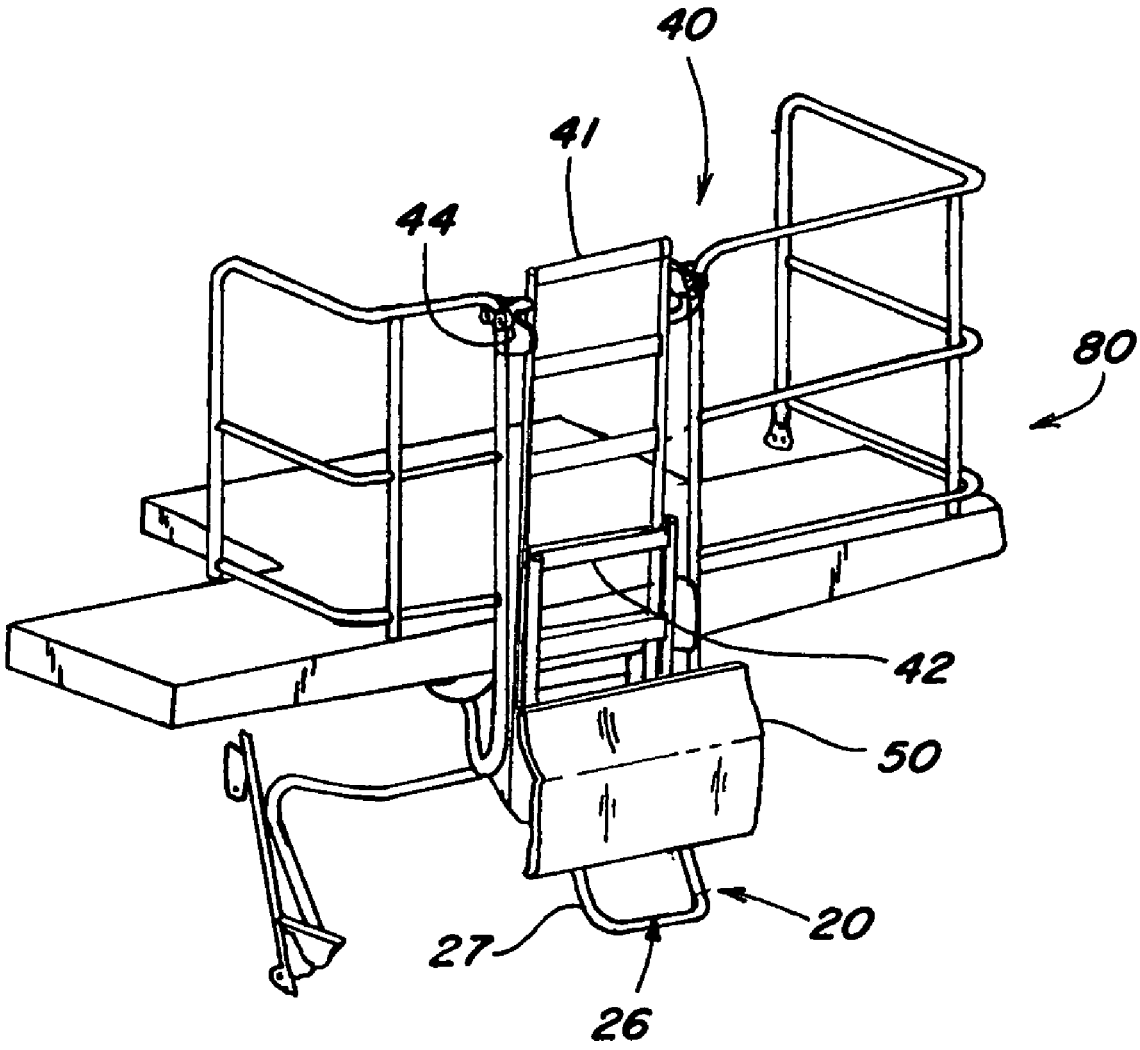
FIG. 1 is a left side perspective of the rear access platform and ladder assembly of a combine incorporating the present invention.
Figure 2:
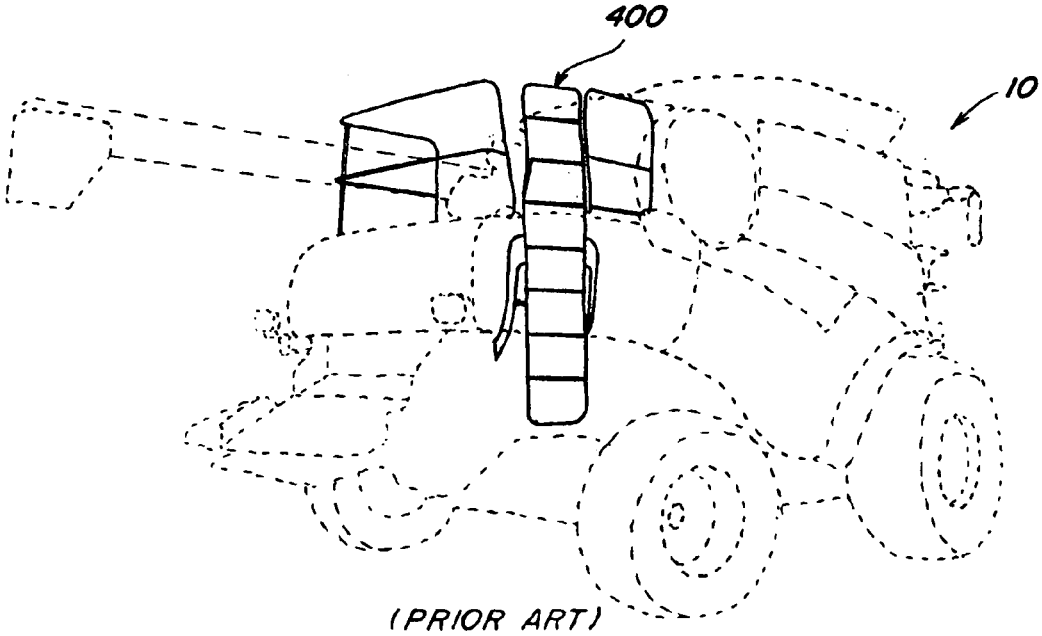
FIG. 2 is a perspective view of a "prior art" combine having its access ladder on the right-hand side of the combine.
Figure 3:
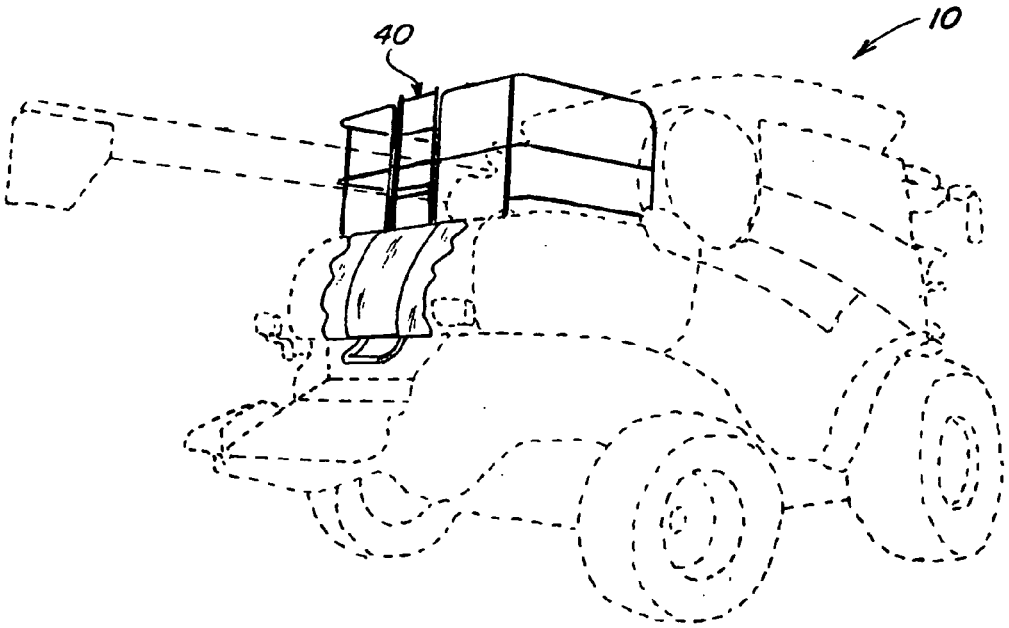
FIG. 3 is a perspective view of a combine showing the rear access ladder of the present invention in its stored position.

Referring generally to the accompanying drawings, the invention disclosed herein can be illustrated on an agricultural vehicle such as the combine shown generally as 10. The combine will typically include the customary chassis or body side walls, and wheels. An operator's platform 80 for an engine service and access catwalk and guardrails is provided at the rear end of the combine. Referring to FIG. 1, the rear access ladder assembly 40 of the present invention is integrally stored in upright fashion on the rear access platform 80 so as to define a movable extension of the handrails. This configuration is in contrast to the prior art access ladder 400 configuration as shown in FIG. 2 which is located on the right-hand side of the engine service platform 80.

Figure 8:
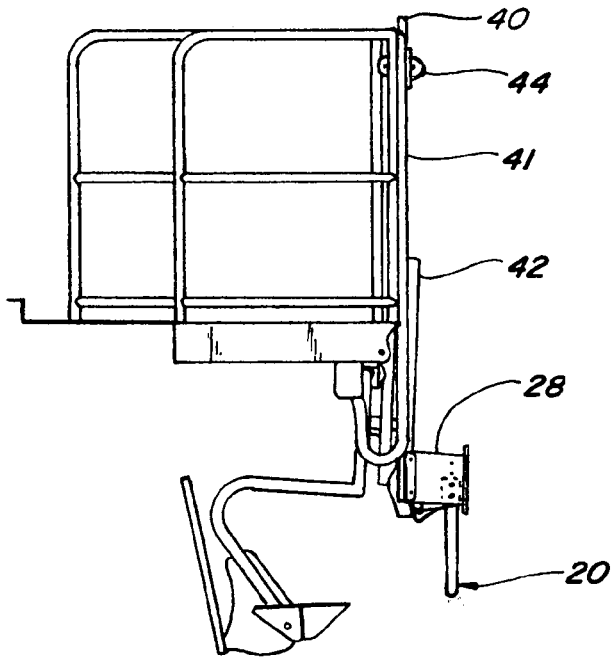
FIG. 8 shows a left side view of the combined ladder and handle assemblies of the present invention when the ladder is in the stored position.
Figure 9:
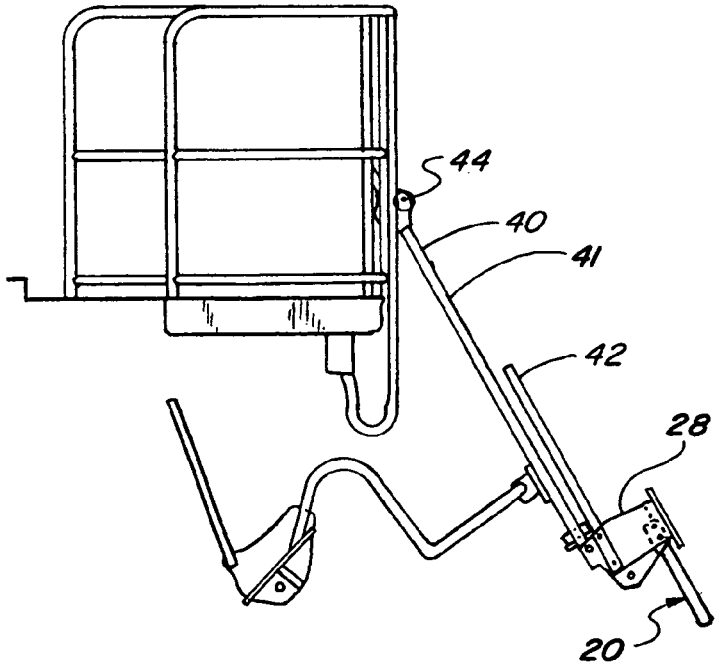
FIG. 9 is a left side view of the combined assembly of FIG. 8 as it is initially moved toward full deployment.
Figure 10:
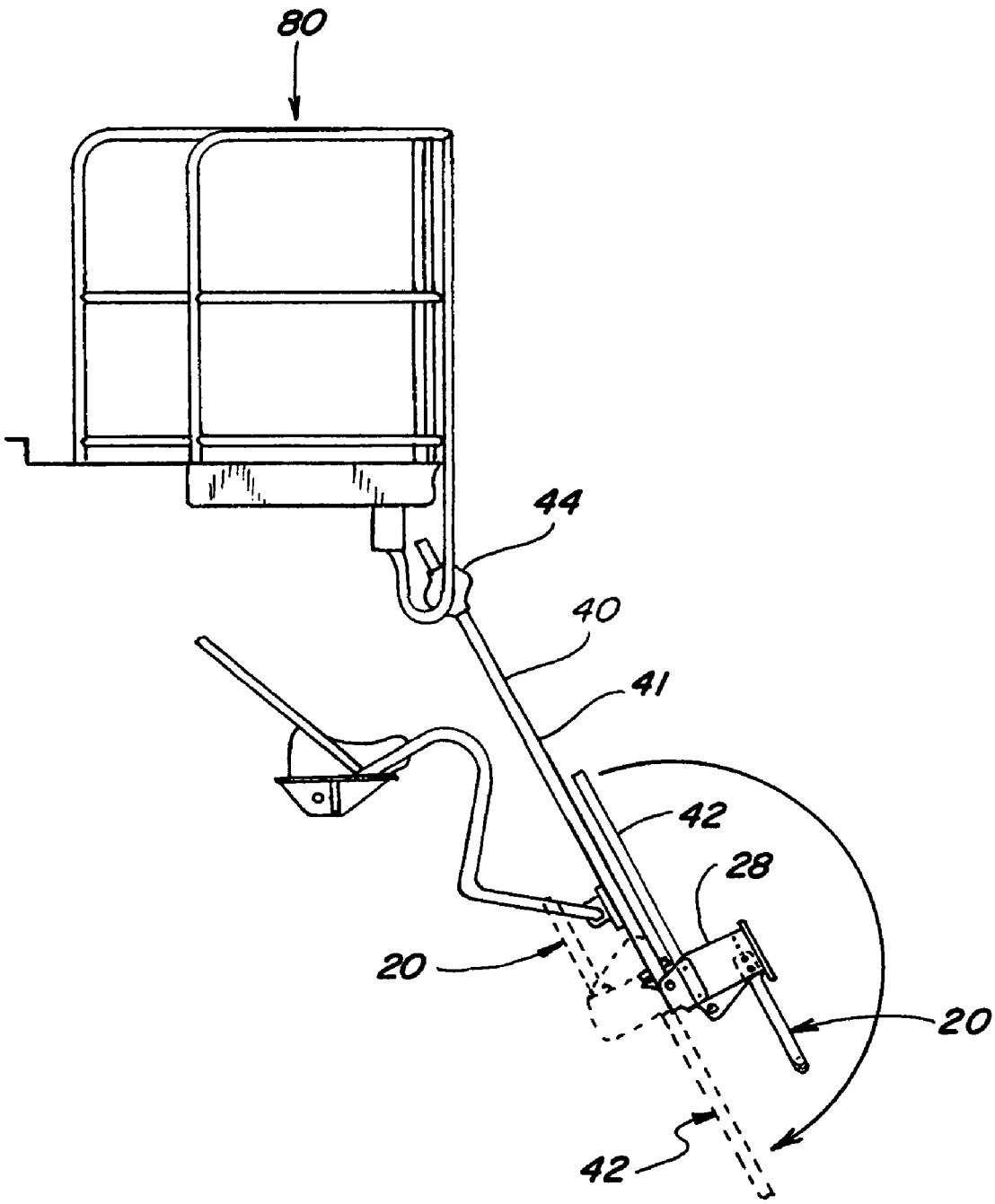
FIG. 10 is a left side view of the combined assembly fully deployed but before the ladder's lower section is deployed.
Figure 11:
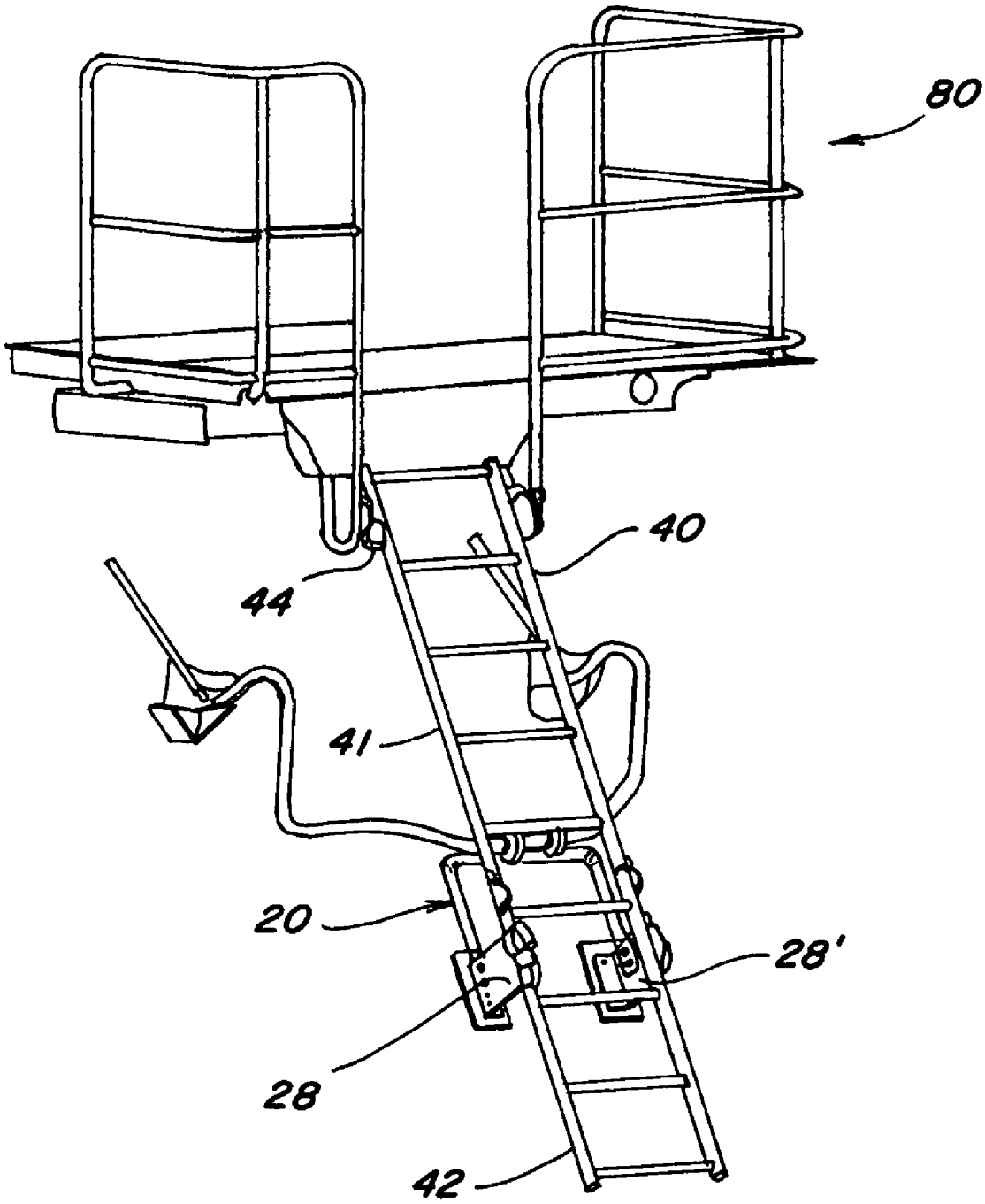
FIG. 11 is a left side perspective of the combined assembly fully deployed.

Referring to the drawings, somewhat out-of-order, FIGS. 8, 9, 10 and 11, illustrate a progression from FIG. 8, where the rear access ladder assembly 40 of the platform 80 is fully stowed away, to FIG. 9 where the ladder 40 is partially deployed into service, to FIG. 10 where the ladder assembly 40 is more advanced into service, and finally FIG. 11 where ladder assembly 40 is fully deployed and unfolded. Ladder assembly 40 comprises two hinged portions 41 and 42. Ladder portion 41 defines a longer upper portion of ladder 40, which portion 41 is slidingly engaged at its top end rollers 44 to move up and down along two handrails of ladder 40. Trim panel attachment 50 attaches to the bridge plates 28 and 28'.

Figure 4:
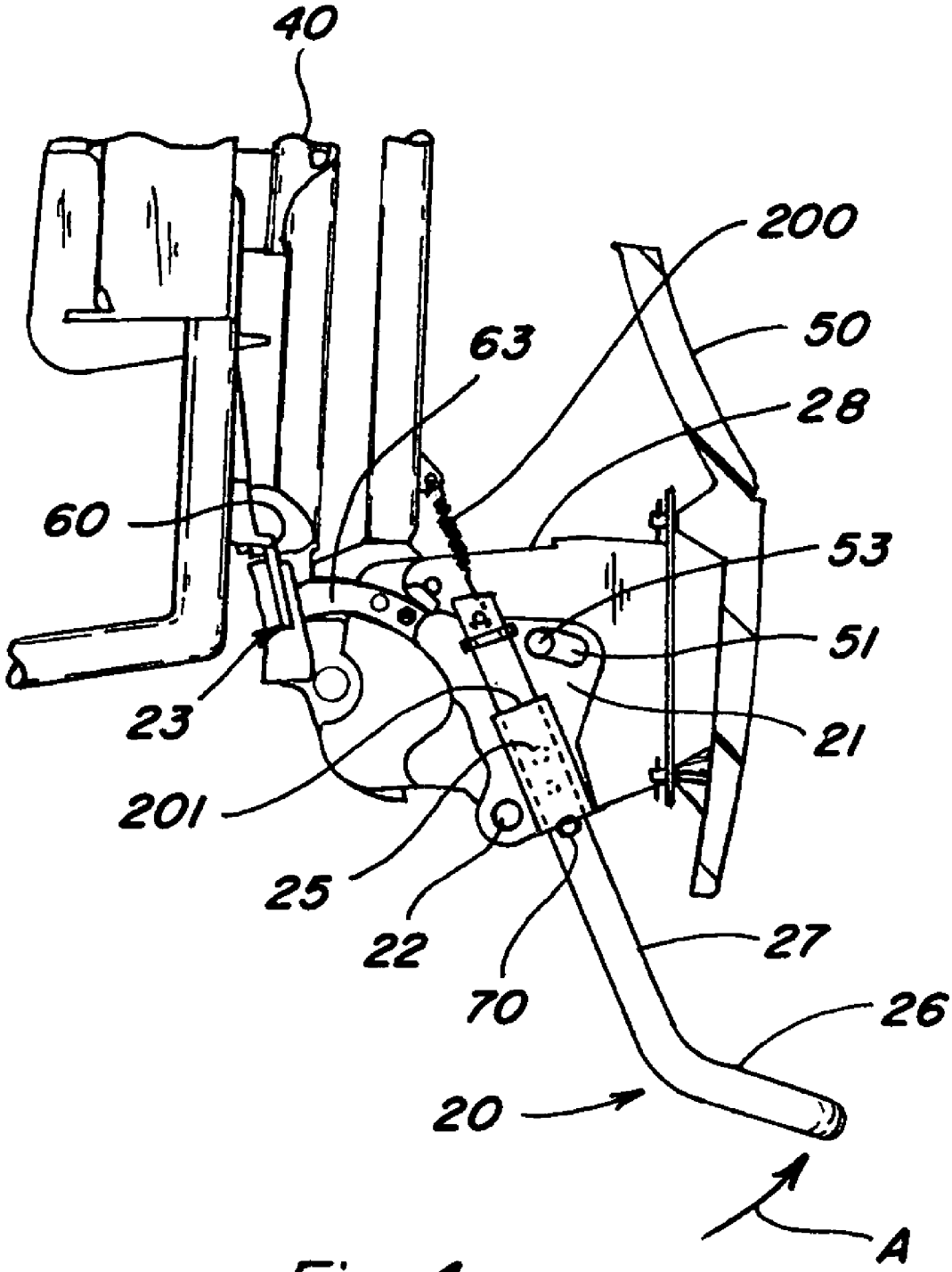
FIG. 4 is a left side view of the handle assembly of the present invention in its stored position.
Figure 5:
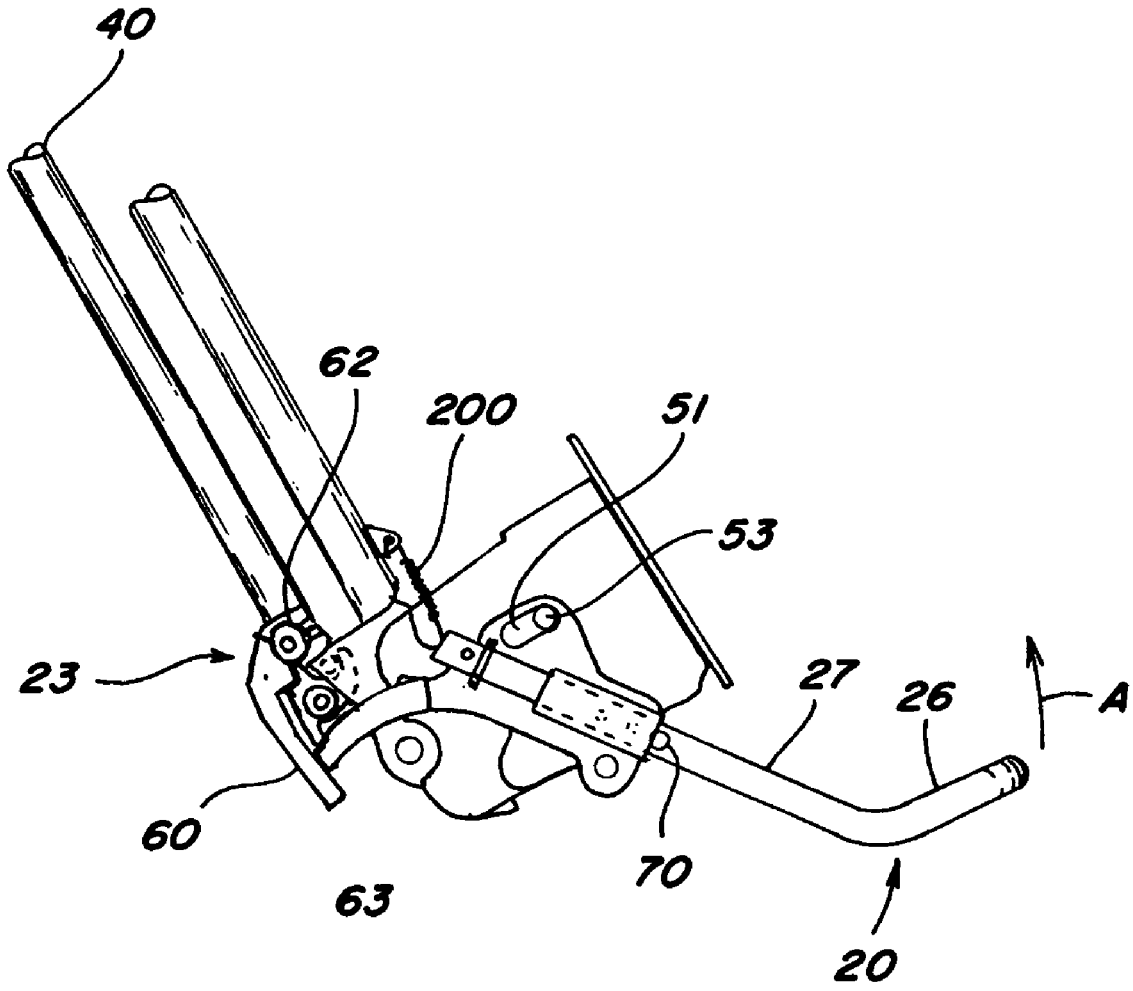
FIG. 5 is a left side view of the handle assembly of FIG. 4 rotated 5-15° in direction A so as to trip the release of the ladder but prior to unfolding its bottom portion.
Figure 6:
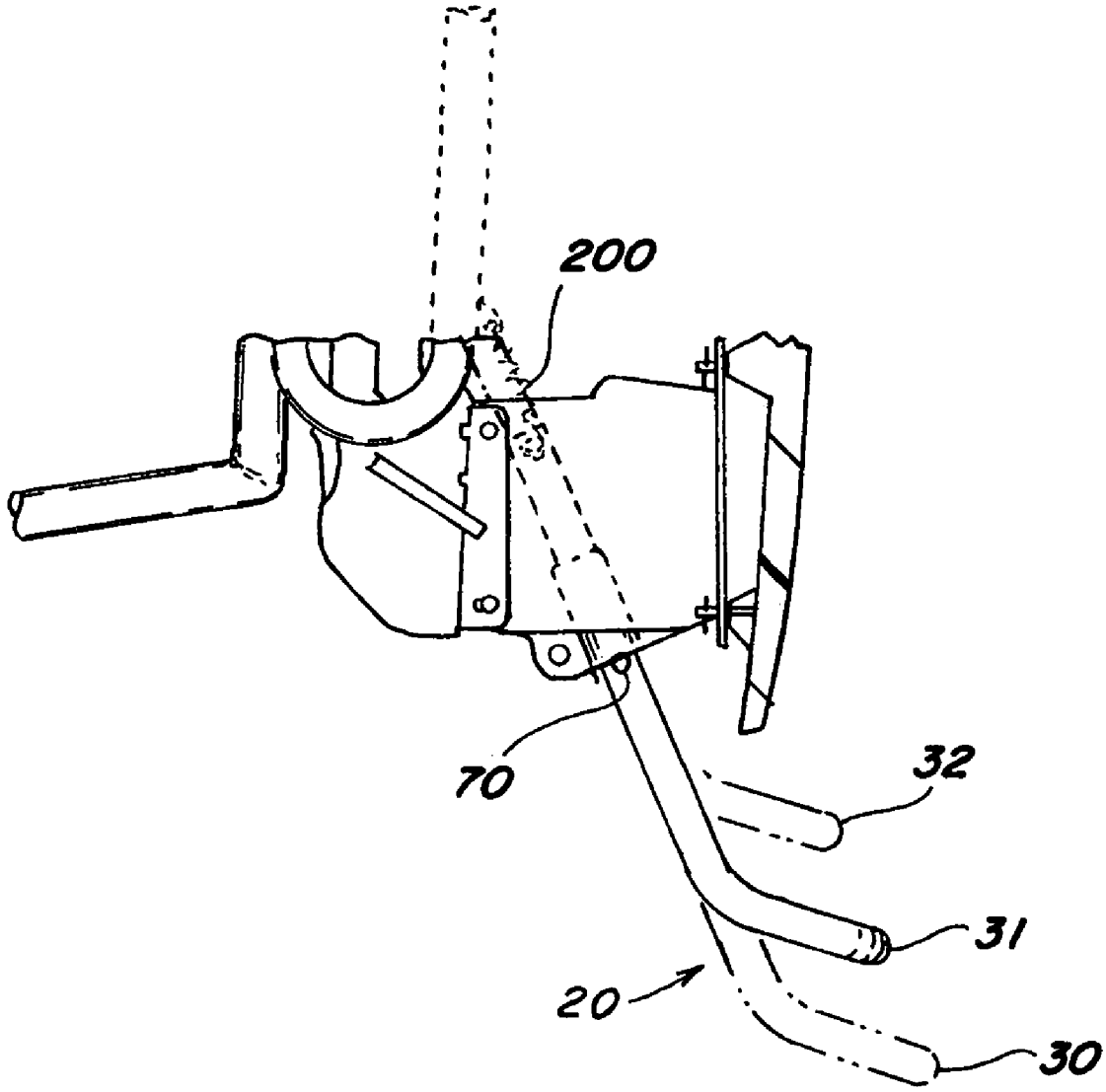
FIG. 6 shows a left side view of the positioning of the handle assembly of the present invention as it is adjusted to the desired height.
Figure 7:
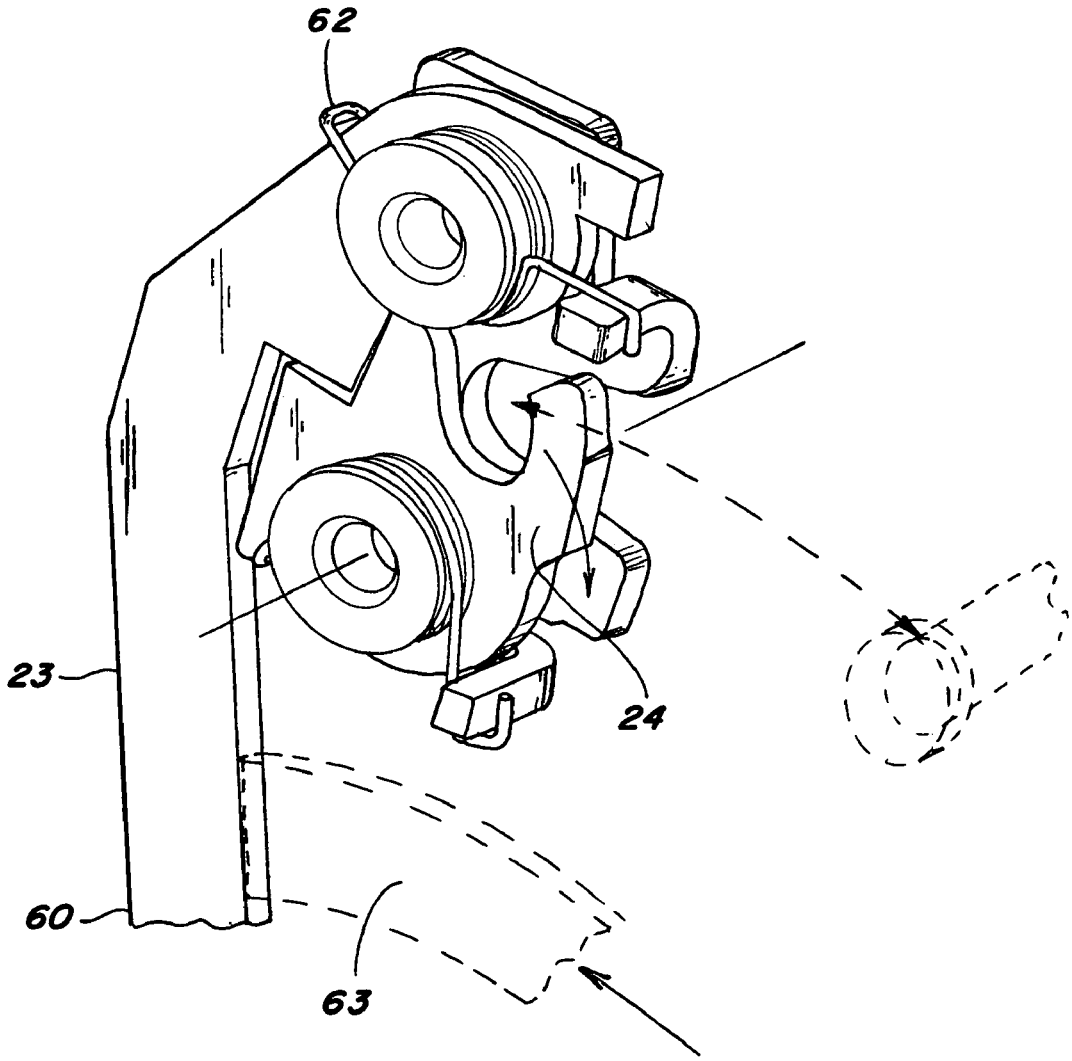
FIG. 7 is a perspective close-up view of a latch mechanism for the present invention.

Handle assembly 20 is preferably U-shaped and is illustrated in FIGS. 4, 5, 6 and 7. Referring now to FIG. 4, a storage latch mechanism 23 cooperates with the release actuation contact 63 which is integrated into pivot bracket 21, which bracket supports handle assembly 20 that extends downward therefrom. The bracket 21 is rotatably fitted flush against bridge plate 28 and rotates about pivot point 22 via slot 51 until stop notch 53 stops said rotation. There is a similar bracket assembly 21' rotatably fitted onto bridge plate 28'. Thus, handle 20 if rotated for about 5°-15° in accordance with directional arrow A, its protrusion 63 creates contact with latch member 23, at latch release lever 60, to release said latch 23 against the bias of tension spring 62 (see FIG. 7), and in turn to release ladder assembly 40 from its secure storage position. The rotational movement is constrained by virtue of a curved slot 51 which guides the back end of pivot bracket 21 about stop notch 53 and against a tension spring 200. This movement provides adequate travel so that the stop notch element 53 of bridge plate 28 which is stationary within the slot while also maintaining a firm, secure station for handle 20 when being gripped by the operator at grasp point 26. Handle 20 features multiple height positions 20 by virtue of spring loaded pin 70 that can be moved into either of several holes 25 in pivot bracket 21 or in a sleeve 201 attached to said bracket 21 and, said height positioning of handle 20 working against the tension of spring 200. Pivot bracket 21 rotates around its pivot point 22 by way of said pivot point 22 being a pin or the like fixed into bridge plates 28/28' to support the handle 20 position between trim member 50 and ladder 40. Handle assembly 20 has a vertical arms 27 and 27', which arm 27 is the portion of handle assembly 20 extending up through sleeve 201 on pivot bracket 21 on the left side of the handle 20 assembly. FIG. 7 shows jaw member 24 of latch 23 and serves as a secondary device having the primary function of positively securing and positioning ladder 40 in either the storage or working (deployed) position. A duplicate pivot plate 21' is rotatably fixed on a bridge plate 28' fixed opposite of bridge plate 28 connecting or bridging the ladder assembly 40 and trim 50.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

What is claimed is:

1. A ladder assembly for accessing an elevated platform of a work machine, comprising:

(a) an upper ladder portion including an upper end in connection with an element of the elevated platform for generally upward and downward movement of the upper ladder portion relative to the platform, the upper ladder portion having a lower end coupled to a pivot bracket, wherein the pivot bracket pivots about the lower end relative to the upper ladder portion between a stowed position and a deployed position;

(b) a handle assembly and a lower ladder portion fixedly connected to the pivot bracket, such that the handle assembly extends in a first direction and the lower ladder portion extends in a second direction, the second direction is opposite to the first direction, wherein the first and second directions are parallel to each other, wherein when the pivot bracket is in the stowed position, the lower ladder portion extends upwardly from the lower end of the upper ladder portion and a handle of the handle assembly extends downwardly therefrom, and when the pivot bracket is in the deployed position, the lower ladder portion extends downwardly from the lower end of the upper ladder portion and the handle extends generally upwardly in relation thereto; and (c) a latch mechanism disposed on the pivot bracket is configured for latching and holding the lower ladder portion in the stowed position, the latch mechanism including a latch release element disposed and configured to be movable in a predetermined manner for releasing and allowing pivotal movement of the lower ladder portion from the stowed position, and an element in connection with the handle disposed and configured when the lower ladder portion is in the stowed position so as to be movable by a predetermined movement of the handle to cooperatively contact and move the latch release element in the predetermined manner to release the lower ladder portion.

2. The ladder assembly of claim 1, wherein the handle is configured and connected to the lower ladder portion such that the predetermined movement of the handle comprises an upward movement relative to the lower ladder portion.

3. The ladder assembly of claim 2, wherein the upward movement relative to the lower ladder portion comprises about a 5 to 15 degree rotation of the handle relative to the lower ladder portion.

4. The ladder assembly of claim 1, wherein the handle is U-shaped.

5. The ladder assembly of claim 1, wherein the handle assembly comprises a bracket supporting the handle for limited outward movement relative to the lower ladder portion.

6. The ladder assembly of claim 1, wherein the handle assembly comprises a bracket supporting the handle and carrying a trim panel disposed so as to face outwardly from the work machine in covering relation to the latch mechanism when the lower ladder portion is in the stowed position.

7. The ladder assembly of claim 6, wherein the trim panel is disposed so as to face the work machine when the lower ladder portion is in the deployed position.

8. The ladder assembly of claim 1, wherein the work machine comprises an agricultural combine and the elevated platform comprises an engine service platform of the combine.

9. A ladder assembly for an elevated platform of an agricultural combine, comprising:

(a) an upper ladder portion including an upper end in connection with an element of the elevated platform for upward and downward movement of the upper ladder portion relative to the platform, and simultaneous pivotal movement of a lower end of the upper ladder portion toward and away from the platform, the upper ladder portion having a lower end coupled to a pivot bracket, wherein the pivot bracket pivots about the lower end relative to the upper ladder portion between a stowed position and a deployed position;

(b) a lower ladder portion and handle assembly fixedly connected to the pivot bracket, such that the handle assembly extends in a first direction and the lower ladder portion extends in a second direction, the second direction is opposite to the first direction, wherein the first and second directions are parallel to each other, wherein when the pivot bracket is in the stowed position, the lower ladder portion extends upwardly along the lower end of the upper ladder portion and a handle of the handle assembly extends generally downwardly therefrom, and when the pivot bracket is in the deployed position, the lower ladder portion extends downwardly from and forms an extension of the lower end of the upper ladder portion and the handle is disposed generally between the ladder assembly and the combine; and (c) a latch mechanism disposed on the pivot bracket for latching the lower ladder portion when in the stowed position to the lower end of the upper ladder portion, the latch mechanism including a release element disposed and configured to be movable in a predetermined manner for releasing and allowing pivotal movement of the lower ladder portion from the stowed position, and the handle being disposed and configured such that when the lower ladder portion is in the stowed position the handle can be manipulated to bring an element of the handle assembly to bear against and move the release element to release the lower ladder portion.

10. The ladder assembly of claim 9, wherein the handle assembly comprises an element supporting the handle for limited outward movement relative to the lower ladder portion.

11. The ladder assembly of claim 9, wherein the handle assembly comprises a bracket supporting the handle and carrying a trim panel disposed so as to face outwardly from the combine in covering relation to the latch mechanism when the lower ladder portion is in the stowed position and which will rotate about the lower end of the upper ladder portion to a position between the combine and the ladder assembly when the lower ladder portion is moved to the deployed position.

12. A ladder assembly for accessing an elevated platform of an agricultural combine, comprising:

(a) an upper ladder portion connected to an upstanding handrail of the elevated platform for upward and downward movement relative thereto between a raised position generally vertically coextensive with the handrail, and a lowered position extending downwardly therefrom, the upper ladder portion having a lower end coupled to a pivot bracket, wherein the pivot bracket pivots about the lower end relative to the upper ladder portion between a stowed position and a deployed position;

(b) a lower ladder portion and handle assembly fixedly connected to the pivot bracket, such that the handle assembly extends in a first direction and the lower ladder portion extends in a second direction, the second direction is opposite to the first direction, wherein the first and second directions are parallel to each other, when the pivot bracket is in the stowed position, the lower ladder portion extends upwardly from the lower end of the upper ladder portion and is generally vertically coextensive with at least a portion of the upper ladder portion and a handle of the handle assembly extends generally downwardly therefrom, when the pivot bracket is in the deployed position, the lower ladder portion extends downwardly from the lower end of the upper ladder portion and the handle extends generally upwardly and is disposed generally between the ladder assembly and the combine; and (c) a latch mechanism disposed on the pivot bracket is configured for latching and holding the lower ladder portion in the stowed position, the latch mechanism including a release element disposed and configured to be movable in a manner for releasing and allowing pivotal movement of the lower ladder portion from the stowed position, and the handle being disposed and configured such that when the lower ladder portion is in the stowed position the handle can be manipulated to bring an element of the handle assembly to bear against and move the release element to release the lower ladder portion.

13. The ladder assembly of claim 12, wherein the handle assembly comprises an element supporting the handle for limited outward movement relative to the lower ladder portion.

14. The ladder assembly of claim 12, wherein the handle assembly comprises a bracket supporting the handle and carrying a trim panel disposed so as to face outwardly from the combine in covering relation to the latch mechanism when the lower ladder portion is in the stowed position and which will rotate about the lower end of the upper ladder portion to a position between the combine and the ladder assembly when the lower ladder portion is moved to the deployed position.

* * * * *